US010909906B2

(12) United States Patent
Kim et al.

(10) Patent No.: US 10,909,906 B2
(45) Date of Patent: Feb. 2, 2021

(54) DISPLAY DEVICE

(71) Applicant: Samsung Display Co., Ltd., Yongin-Si (KR)

(72) Inventors: Wontae Kim, Hwaseong-si (KR); Taegon Im, Gwangmyeong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/707,402

(22) Filed: Dec. 9, 2019

(65) Prior Publication Data

US 2020/0111406 A1 Apr. 9, 2020

Related U.S. Application Data

(63) Continuation of application No. 15/496,517, filed on Apr. 25, 2017, now Pat. No. 10,504,411.

(30) Foreign Application Priority Data

Apr. 26, 2016 (KR) ..... 10-2016-0051094

(51) Int. Cl.
*G09G 3/20* (2006.01)
*G09G 5/00* (2006.01)

(52) U.S. Cl.
CPC ..... *G09G 3/2092* (2013.01); *G09G 5/008* (2013.01); *G09G 2310/0218* (2013.01); *G09G 2310/08* (2013.01)

(58) Field of Classification Search
CPC ..... G09G 3/3685–3688; G09G 2310/0264; G09G 2310/027–0275; G09G 2310/0286–0294
See application file for complete search history.

(56) References Cited

U.S. PATENT DOCUMENTS

2016/0217768 A1 7/2016 Pyun et al.
2016/0379588 A1 12/2016 Kim et al.
2017/0092179 A1 3/2017 Lee et al.

FOREIGN PATENT DOCUMENTS

KR 10-2006-0119086 A 11/2006
KR 10-2007-0109414 A 11/2007

*Primary Examiner* — Michael Pervan
(74) *Attorney, Agent, or Firm* — Innovation Counsel LLP

(57) ABSTRACT

A display device according to an embodiment of the inventive concept includes a data driving unit, a gate driving unit, a signal control unit for controlling driving of the data driving unit and the gate driving unit, and a display panel. The data driving unit generates an internal clock signal for outputting data voltages corresponding to image data, and the display panel displays an image corresponding to the data voltages in response to a gate driving signal outputted from the gate driving unit. The data driving unit includes a filtering unit for converting a first frequency control signal received from the signal control unit so as to generate a second frequency control signal, and a clock training unit for training a clock signal received from the signal control unit so as to generate the internal clock signal in response to the second frequency control signal.

18 Claims, 9 Drawing Sheets

DISPLAY DEVICE

CROSS-REFERENCE TO RELATED APPLICATION

This application is a continuation application of U.S. patent application Ser. No. 15/496,517 filed on Apr. 25, 2017, which claims priority to Korean Patent Application No. 10-2016-0051094 filed on Apr. 26, 2016 in the Korean Intellectual Property Office (KIPO), and all the benefits accruing therefrom under 35 U.S.C. § 119, the contents of the prior applications being herein incorporated by reference.

BACKGROUND

The present disclosure herein relates to a display device, and more particularly, to a display device conforming to an interface specification between a signal control unit and a data driving unit.

A display device includes a display panel for displaying an image, a gate driving unit and a data driving unit for driving the display panel. The display panel includes a plurality of gate lines, a plurality of data lines, and a plurality of pixels respectively connected to the gate lines and the data lines. The plurality of pixels display gradations corresponding to data voltages supplied from the data driving unit. Accordingly, an image is displayed in the display panel.

Additionally, the display device includes a signal control unit for controlling the gate driving unit and the data driving unit. The signal control unit generates a plurality of driving signals for controlling the gate driving unit and the data driving unit in response to an external control signal. The signal control unit transmits a data driving signal and a plurality of image data to the data driving unit through an interface between the signal control unit and the data driving unit.

Meanwhile, there is a case that there occurs an error in driving of the data driving unit by noise or the like when the data driving signal and the plurality of image data are transmitted from the signal control unit to the data driving unit.

SUMMARY

The present disclosure provides a display device having improved driving reliability of a data driving unit.

An embodiment of the inventive concept provides a display device including a signal control unit configured to output a gate driving signal, a clock signal having frequency information, a plurality of image data corresponding to a plurality of frame images, and a first frequency control signal for defining a plurality of frame periods in which the plurality of frame images are respectively displayed. A data driving unit has a signal processing unit configured to train the clock signal received from the signal control unit to generate an internal clock signal, and a data converting unit configured to convert the plurality of image data to a plurality of data voltages in response to the internal clock signal, and to output the data voltages. A gate driving unit is configured to output a gate signal in response to the gate driving signal received from the signal control unit. A display panel is configured to display the plurality of frame images corresponding respectively to the plurality of data voltages in response to the gate signal. The signal processing unit includes: a filtering unit configured to receive the first frequency control signal, and generate a second frequency control signal having a first level when a level of the first frequency control signal is maintained at the first level for a preset determination period, and having a second level when a level of the first frequency control signal is maintained at the second level for the determination period; and a clock training unit configured to perform clock training for generating the internal clock signal in response to the second frequency control signal.

In an embodiment, the data driving unit may further include a reference clock signal generating unit configured to generate a reference clock signal for determining the determination period, and the filtering unit may compare a level of the first frequency control signal for each cycle of the reference clock signal. When the first frequency control signal has been maintained at one level of the first and second levels for at least n cycles of the reference clock signal, where n is a natural number greater than or equal to two, the filtering unit may convert a level of the second frequency control signal to the one level of the first frequency control signal from an (n+1)-th cycle of the reference clock signal.

In an embodiment, when a level of the first frequency control signal is not maintained to be constant at one level of the first and second levels for the n cycles, the filtering unit may be configured to maintain a level of the second frequency control signal to be unconverted in the (n+1)-th cycle.

In an embodiment, the filtering unit may include: a signal generating unit configured to output n input signals respectively including level information of the first frequency control signal in the n cycles; a comparing unit configured to compare the n input signals to determine whether a level of the first frequency control signal remains constant for the n cycles; and an output unit configured to output, when the comparing unit determines that the level of the first frequency control signal has remained constant for the n cycles, the second frequency control signal having, in the (n+1)-th cycle, the same level as the level of the first frequency control signal.

In an embodiment, the signal generating unit may include n flip-flops configured to generate the n input signals, and n inverted signals respectively having level values inverted from level values of the n input signals.

In an embodiment, the comparing unit may include: a first NAND circuit configured to combine the n input signals to output a first comparison signal; a second NAND circuit configured to combine the n inverted signals to output a second comparison signal; and a latch unit connected to each of the first NAND circuit and the second NAND circuit, and configured to output a result signal having one of the first level and the second level on the basis of the first comparison signal and the second comparison signal.

In an embodiment, the output unit may include: a first inverter configured to output an inverted result signal having a level inverted from a level of the result signal; a second inverter configured to invert the inverted result signal to the result signal again; and an output flip-flop configured to convert, in the (n+1)-th cycle, a level of the second frequency control signal to the level of the result signal.

In an embodiment, the signal control unit may be configured to further output a plurality of blank data, the plurality of image data may be outputted in the plurality of frame periods, and the plurality of blank data may be outputted in a plurality of blank periods alternately repeated with the plurality of frame periods respectively.

In an embodiment, each of the plurality of blank data may include pattern data for the clock training, and the clock training unit may be configured to perform the clock training using the pattern data.

In an embodiment, each of the plurality of image data may include dummy data and active data, one frame period of the plurality of frame periods may be disposed between a first blank period and a second blank period, and a dummy data period included in the one frame period may be disposed to be adjacent to at least one of the first blank period or the second blank period.

An embodiment of the inventive concept provides a data driving unit including: a filtering unit configured to receive a first frequency control signal from a signal control unit, and to generate, on the basis that a level of the first frequency control signal is maintained to be constant at one level of a first level and a second level for a preset determination period, a second frequency control signal converted to have the same level as the one level. A clock training unit is configured to receive a clock signal including frequency information from the signal control unit, and to generate an internal clock signal corresponding to the clock signal while performing training of the clock signal in response to the second frequency control signal. A data converting unit is configured to convert a plurality of image data corresponding to a plurality of frame images to a plurality of data voltages in response to the internal clock signal, and to output the data voltages.

An embodiment of the inventive concept provides a method of driving a display device including outputting a clock signal having frequency information, a gate driving signal, a plurality of image data corresponding to a plurality of frame images, and a first frequency control signal for defining a plurality of frame periods in which the plurality of frame images are respectively displayed. The method further includes generating a second frequency control signal having a first level when a level of the first frequency control signal is maintained at the first level for a preset determination period, and having a second level when a level of the first frequency control signal is maintained at the second level for the determination period. The method further includes generating an internal clock signal while performing training of the clock signal in response to the second frequency control signal; converting the plurality of image data to a plurality of data voltages in response to the internal clock signal, and outputting the data voltages; outputting a gate signal in response to the gate driving signal; and displaying the plurality of frame images corresponding respectively to the plurality of data voltages in response to the gate signal.

In an embodiment, the generating of the second frequency control signal may include: generating a reference clock signal for determining the determination period; and comparing a level of the first frequency control signal for each cycle of the reference clock signal, and, when the first frequency control signal has been maintained at one level of the first and second levels for at least n cycles of the reference clock signal, where n is a natural number greater than or equal to two, converting a level of the second frequency control signal to the one level of the first frequency control signal from an (n+1)-th cycle of the reference clock signal.

In an embodiment, when a level of the first frequency control signal is not maintained to be constant at one level of the first and second levels for the n cycles, a level of the second frequency control signal is maintained to be unconverted in the (n+1)-th cycle.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to describe principles of the inventive concept. In the drawings.

DETAILED DESCRIPTION

Figure 1:
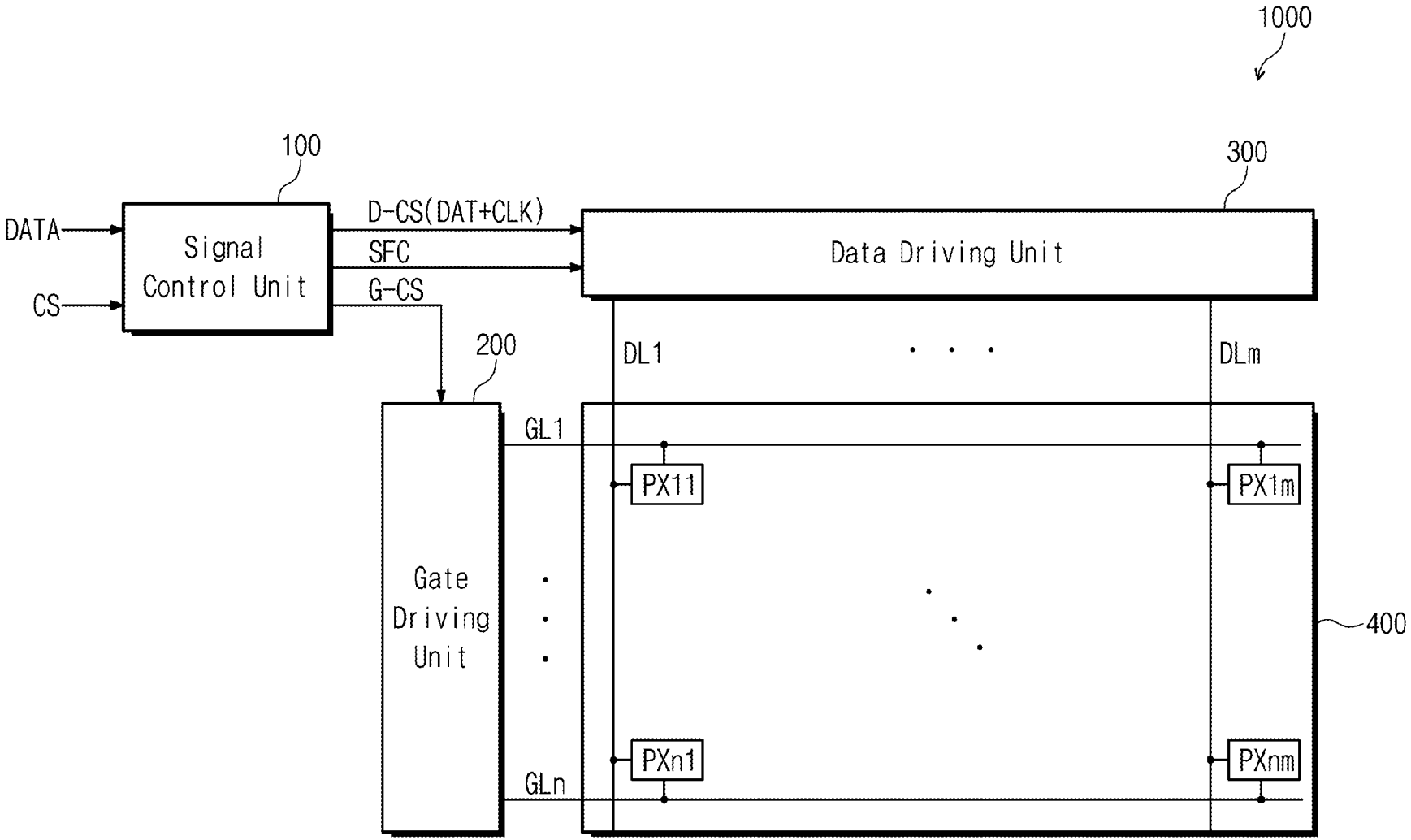
FIG. 1 is a block diagram illustrating a display device according to an embodiment of the inventive concept.

As the inventive concept can have various changes and modifications made thereto and take many forms, specific embodiments of the inventive concept are illustrated in the accompanying drawings and are hereinafter described in detail. However, it should be understood that this is not intended to limit the inventive concept to specific disclosures, but is intended to include all changes and modifications, equivalents, and substitutes within the spirit and scope of the inventive concept.

Similar reference numerals are used for similar elements in the accompanying drawings through the specification. It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the inventive concept. As used herein, the singular forms, "a", "an" and "the" are intended to include the plural forms as well, unless the context clearly indicates otherwise.

It will be further understood that the term "include" or "have", when used in this specification, specifies the presence of stated features, integers, steps, operations, elements, components, and/or groups thereof, but does not preclude the presence or addition of one or more other features, integers, steps, operations, elements, components, and/or groups thereof.

Hereinafter, exemplary embodiments of the inventive concept will be described in more detail with reference to the accompanying drawings.

FIG. 1 is a block diagram illustrating a display device 1000 according to an embodiment of the inventive concept.

Referring to FIG. 1, the display device 1000 may include a signal control unit 100, a gate driving unit 200, a data driving unit 300, and a display panel 400.

The display panel 400 may include a plurality of gate lines GL1 to GLn, and a plurality of data lines DL1 to DLm. More specifically, the plurality of gate lines GL1 to GLn may be arranged to extend in a lateral direction and to cross each of the plurality of data lines DL1 to DLm extending in a longitudinal direction.

Additionally, the display panel 400 may include a plurality of pixels PX11 to PXnm each connected to a corresponding gate line and a corresponding data line respectively among the plurality of gate lines GL1 to GLn and the plurality of data lines DL1 to DLm.

The signal control unit 100 may receive a plurality of input image data DATA corresponding to a plurality of frame images, and a plurality of control signals CS from the outside. The plurality of control signals CS may include, as an example, a vertical synchronization signal, a horizontal synchronization signal, a main clock signal, a data enable signal, and the like which control the plurality of input image data DATA.

The signal control unit 100 may convert a data format of the plurality of input image data DATA so as to conform to an interface specification between the signal control unit 100 and the data driving unit 300. A plurality of image data DAT with the converted data format may be supplied to the data driving unit 300.

The signal control unit 100 may output a plurality of driving signals in response to the plurality of control signals CS. The signal control unit 100 may generate a first frequency control signal SFC, a data driving signal D-CS, and a gate driving signal G-CS as the plurality of driving signals.

The data driving signal D-CS may include, as an example, an output start signal, a horizontal start signal, and the like. The data driving signal D-CS according to an embodiment of the inventive concept may include the plurality of image data DAT with the converted data format, and a clock signal CLK having frequency information.

The gate driving signal G-CS may include, as an example, a vertical start signal, a vertical clock signal, and the like. The signal output unit 100 transmits the data driving signal D-CS to the data driving unit 300, and transmits the gate driving signal G-CS to the gate driving unit 200.

The gate driving unit 200 may be connected to each of the plurality of gate lines GL1 to GLn. The gate driving unit 200 may sequentially output a plurality of gate signals respectively to the plurality of gate lines GL1 to GLn in response to the gate driving signal G-CS supplied from the signal control unit 100.

The data driving unit 300 may be connected to each of the plurality of data lines DL1 to DLm. The data driving unit 300 may convert the plurality of image data DAT to a plurality of data voltages in response to the data driving signal D-CS supplied from the signal control unit 100. Additionally, the data driving unit 300 may generate an internal clock signal from a clock signal CLK included in the plurality of image data DAT, and may output the plurality of data voltages respectively to the plurality of data lines DL1 to DLm in response to the internal clock signal.

Accordingly, the display panel 400 may output the plurality of frame images using the plurality of gate signals received from the gate driving unit 200, and the plurality of data voltages received from the data driving unit 300.

Figure 2:
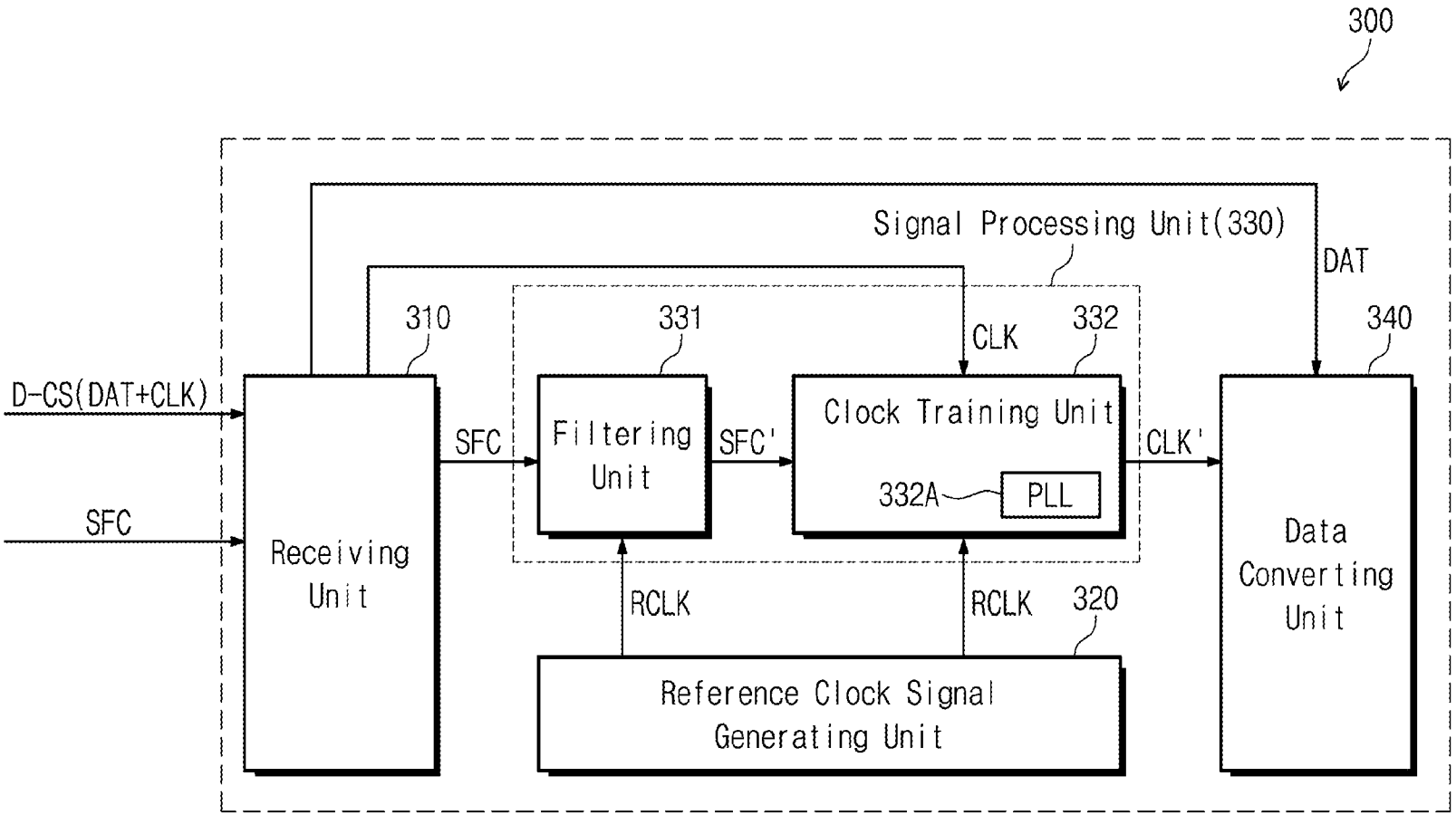
FIG. 2 is a block diagram illustrating a data driving unit according to an embodiment of the inventive concept.
Figure 3:
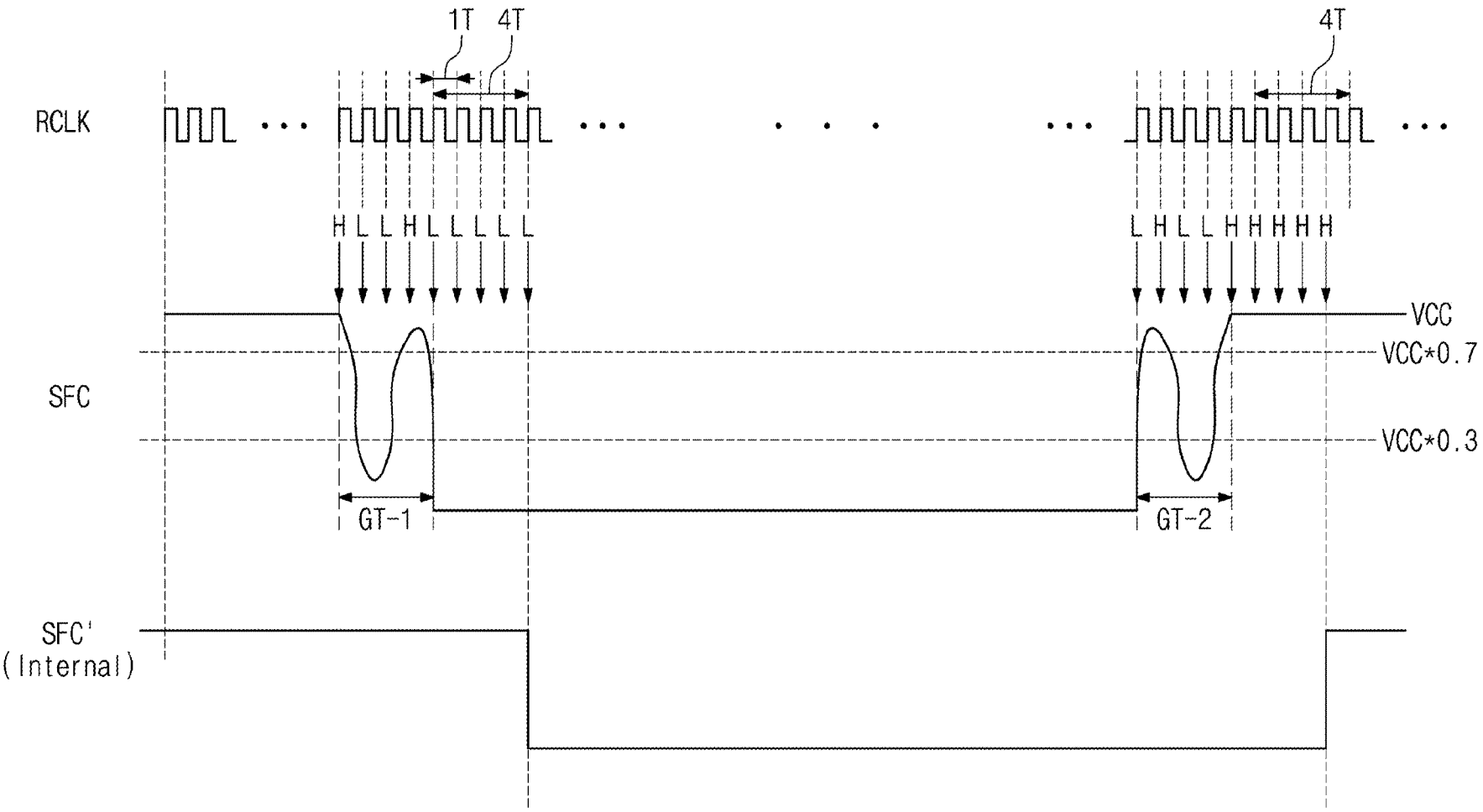
FIG. 3 is a conceptual diagram illustrating a first frequency control signal and a second frequency control signal according to an embodiment of the inventive concept.

FIG. 2 is a block diagram illustrating the data driving unit 300 according to an embodiment of the inventive concept, and FIG. 3 is a conceptual diagram illustrating the first frequency control signal SFC and a second frequency control signal SFC' according to an embodiment of the inventive concept.

The data driving unit 300 may include a receiving unit 310, a reference clock signal generating unit 320, a signal processing unit 330, and a data converting unit 340. The signal processing unit 330 according to an embodiment of the inventive concept may include a filtering unit 331, and a clock training unit 332.

The receiving unit 310 may separate signals received from the signal control unit 100, and output the separated signals to the filtering unit 331, the clock training unit 332, and the data converting unit 340 respectively. More specifically, the receiving unit 310 may separate out the first frequency control signal SFC, and output the same to the filtering unit 331, and may extract the clock signal CLK from the plurality of image data DAT included in the data driving signal D-CS, and output the clock signal CLK to the clock training unit 332. Additionally, the receiving unit 310 may output the plurality of image data DAT to the data converting unit 340.

Although only the plurality of image data DAT and the clock signal CLK are illustrated as the data driving signal D-CS in FIG. 2, the data driving signal D-CS according to an embodiment of the inventive concept may further include the horizontal synchronization signal, the data enable signal, and the like related to image data output.

The reference clock signal generating unit 320 may generate a reference clock signal RCLK which becomes a reference for driving the data driving unit 300. As an example, the reference clock signal generating unit 320 may generate the reference clock signal RCLK having a preset frequency, and supply the reference clock signal RCLK to the signal processing unit 330.

The signal processing unit 330 may include the filtering unit 331 for filtering the first frequency control signal SFC, and the clock training unit 332 for generating an internal clock signal CLK' from the clock signal CLK.

The filtering unit 331 may generate the second frequency control signal SFC' converted from the first frequency control signal SFC on the basis of a level analysis of the first frequency control signal SFC. The first frequency control signal SFC according to an embodiment of the inventive concept may be a control signal of clock training for determining a time period for training the internal clock signal.

The filtering unit 331 may analyze a level of the first frequency control signal SFC using the reference clock signal RCLK supplied from the reference clock signal generating unit 320. As an example, the filtering unit 331 may analyze the level of the first frequency control signal SFC for a preset determination period of the reference clock signal RCLK.

More specifically, the filtering unit 331 may determine the level of the first frequency control signal SFC for each cycle 1T of the reference clock signal RCLK. In this case, the level of the first frequency control signal SFC may be a voltage level of the first frequency control signal SFC. As an example, as illustrated in FIG. 3, the filtering unit 331 may determine that a level of the first frequency control signal SFC is a first level H in the case that the level of the first frequency control signal SFC has a voltage level higher than 0.7 times a reference voltage Vcc. Additionally, the filtering unit 331 may determine that a level of the first frequency control signal SFC is a second level L in the case that the level of the first frequency control signal SFC has a voltage level lower than 0.3 times the reference voltage Vcc.

Alternatively, the filtering unit 331 may compare a level of the first frequency control signal SFC by having, as the preset determination period, an arbitrary period corresponding to a preset number n of cycles Nt, where n is a natural number greater than or equal to two, according to the reference clock signal RCLK. The filtering unit 331 may generate the second frequency control signal SFC' having the first level H when the level of the first frequency control signal SFC is maintained at the first level H, and having the second level L when the level of the first frequency control signal SFC is maintained at the second level L, for the preset determination period.

As a more specific example, when a level of the first frequency control signal SFC has been maintained at one level of the first level H and the second level L for at least n cycles of the reference clock signal RCLK, the filtering unit 331 may convert a level of the second frequency control signal SFC' to the one level of the first frequency control signal SFC from an (n+1)-th cycle. Additionally, when a level of the first frequency control signal SFC is not maintained to be constant at one level of the first level H or the second level L for the n cycles, the filtering unit 331 may maintain a level of the second frequency control signal SFC' to be unconverted in the (n+1)-th cycle. That is, the second frequency control signal SFC' having a level in the (n+1)-th cycle the same as that in the n-th cycle may be generated.

Referring to FIG. 3, as an embodiment of the inventive concept, the preset determination period may be set to a period corresponding to four cycles 4T of the reference clock signal RCLK. The filtering unit 331 may analyze a level of the first frequency control signal SFC for the four cycles 4T of the reference clock signal RCLK. When the first frequency control signal SFC is maintained at the first level H for the preset determination period 4T, the second frequency control signal SFC' may have the first level H.

A glitch may occur in the first frequency control signal SFC due to noise (for example, electrostatic discharge (ESD)), fluctuation of input power, or the like. Particularly, a glitch phenomenon may occur in the vicinity of a falling edge at which the first frequency control signal SFC is converted from the first level H to the second level L, or in the vicinity of a rising edge at which the first frequency control signal SFC is converted from the second level L to the first level H. For ease of description, a period in which a glitch occurs in the vicinity of the falling edge is defined as a first glitch period GT-1, and a period in which a glitch occurs in the vicinity of the rising edge is defined as a second glitch period GT-2. For the first and second glitch periods GT-1 and GT-2, a level of the first frequency control signal SFC may be unstable.

First, when a level of the first frequency control signal SFC is not maintained to be constant for the preset determination period 4T in the first glitch period GT-1, this is determined as a glitch occurrence period, so that the second frequency control signal SFC' maintained at the first level H without level conversion may be generated. Then, when the first frequency control signal SFC is maintained at the second level L at least for the preset determination period 4T after the first glitch period GT-1, the filtering unit 331 may convert the second frequency control signal SFC' to the second level L from the next cycle.

Similarly, when a level of the first frequency control signal SFC is not maintained to be constant for the preset determination period 4T in the second glitch period GT-2, this is determined as a glitch occurrence period, so that the second frequency control signal SFC' maintained at the second level L without level conversion may be generated. Then, when the first frequency control signal SFC is maintained at the first level H at least for the preset determination period 4T after the second glitch period GT-2, the second frequency control signal SFC' may be converted to the first level H from the next cycle.

Accordingly, the filtering unit 331 according to an embodiment of the inventive concept may generate a glitch-free second frequency control signal SFC' even when the glitch phenomenon occurs to the first frequency control signal SFC.

When the second frequency control signal SFC' is generated as described, the filtering unit 331 may transmit the second frequency control signal SFC' to the clock training unit 332.

The clock training unit 332 may perform training of the clock signal CLK supplied from the receiving unit 310 to generate the internal clock signal CLK' by using the reference clock signal RCLK supplied from the reference clock signal generating unit 320.

The clock training unit 332 may perform clock training for generating the internal clock signal CLK' in a preset period of the second frequency control signal SFC' in response to the second frequency control signal SFC'. As described in detail, because the glitch-free second frequency control signal SFC' is supplied to the clock training unit 332 through the filtering unit 331, the clock training unit 332 may perform clock training without error.

The clock training unit 332 according to an embodiment of the inventive concept may include a phase locked loop (PLL) circuit 332A as illustrated in FIG. 2.

The clock training unit 332 may supply the internal clock signal CLK' to the data converting unit 340.

The data converting unit 340 may sample the plurality of image data DAT provided from the receiving unit 310 in response to the internal clock signal CLK', and may convert a plurality of sampled image data DAT' to the plurality of data voltages. Additionally, the data converting unit 340 may output the plurality of data voltages to the plurality of data lines DL1 to DLm (see FIG. 1.) in response to a load signal (not illustrated) included in the data driving signal D-CS.

Figure 4:
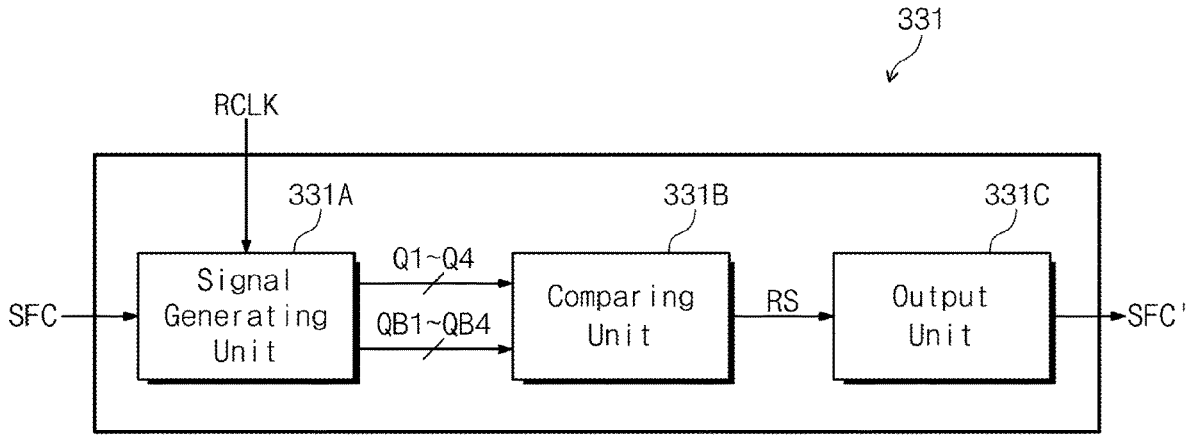
FIG. 4 is a block diagram illustrating a filtering unit according to an embodiment of the inventive concept.
Figure 5:
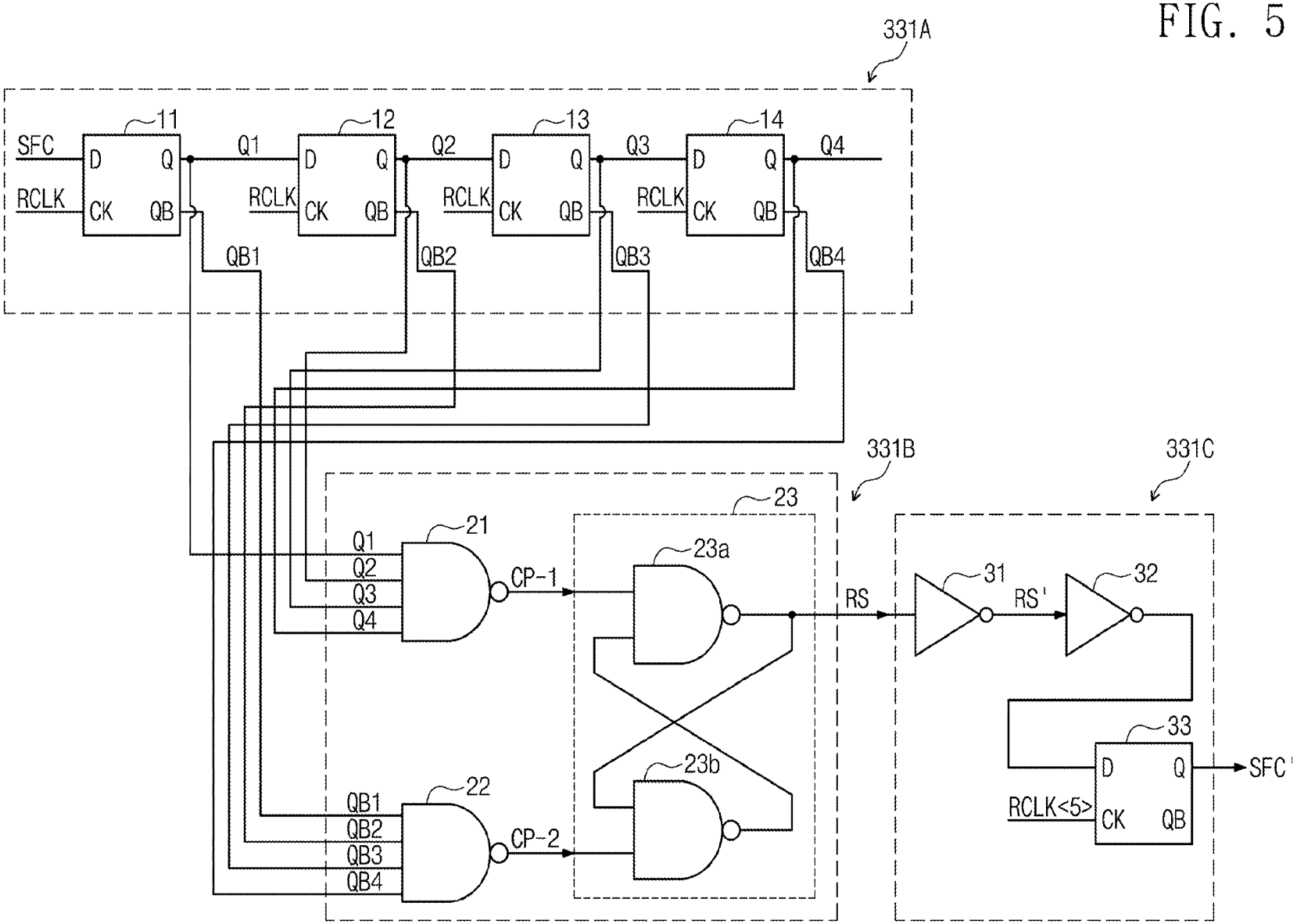
FIG. 5 illustrates an internal circuit configuration of the filtering unit according to FIG. 4.

FIG. 4 is a block diagram illustrating the filtering unit 331 according to an embodiment of the inventive concept, and FIG. 5 illustrates an internal circuit configuration of the filtering unit 331 according to FIG. 4.

Referring to FIG. 4, the filtering unit 331 according to an embodiment of the inventive concept may include a signal generating unit 331A, a comparing unit 331B, and an output unit 331C.

The signal generating unit 331A may receive the first frequency control signal SFC from the receiving unit 310 (see FIG. 2), and the reference clock signal RCLK from the reference clock signal generating unit 320 (see FIG. 2).

The signal generating unit 331A may generate n input signals including level information of the first frequency control signal SFC for respective cycles of the n cycles of the reference clock signal RCLK. Hereinafter, description will be given of the case that n is four according to an embodiment of the inventive concept, in FIGS. 4 and 5. However, n is not limited thereto, but may be set to one of natural numbers greater than or equal to two.

Referring to FIG. 5, the signal generating unit 331A according to an embodiment of the inventive concept may include first to fourth flip-flops 11, 12, 13, and 14 for respectively outputting first to fourth input signals Q1 to Q4 in response to the reference clock signal RCLK. A flip-flop included in the signal generating unit 331A according to an embodiment of the inventive concept may be a delay flip-flop (D-flip-flop) having first and second input terminals and first and second output terminals.

As illustrated in FIG. 5, the first flip-flop 11 among the first to fourth flip-flops 11, 12, 13, and 14 may receive the first frequency control signal SFC through a first input terminal D, and the reference clock signal RCLK through a second input terminal CK. The first flip-flop 11 may output the first input signal Q1 through a first output terminal Q, and a first inverted signal QB1 through a second output terminal QB, in response to the reference clock signal RCLK. The first inverted signal QB1 may have a level inverted from that of the first input signal Q1.

The second flip-flop 12 among the first to fourth flip-flops 11, 12, 13, and 14 may receive the first input signal Q1 through a first input terminal D, and the reference clock signal RCLK through a second input terminal CK. The second flip-flop 12 may output the second input signal Q2 through a first output terminal Q, and a second inverted signal QB2 through a second output terminal QB, in response to the reference clock signal RCLK. The second inverted signal QB2 may have a level inverted from that of the second input signal Q2.

The third flip-flop 13 among the first to fourth flip-flops 11, 12, 13, and 14 may receive the second input signal Q2 through a first input terminal D, and the reference clock signal RCLK through a second input terminal CK. The third flip-flop 13 may output the third input signal Q3 through a first output terminal Q, and a third inverted signal QB3 through a second output terminal QB, in response to the reference clock signal RCLK. The third inverted signal QB3 may have a level inverted from that of the third input signal Q3.

The fourth flip-flop 14 among the first to fourth flip-flops 11, 12, 13, and 14 may receive the third input signal Q3 through a first input terminal D, and the reference clock signal RCLK through a second input terminal CK. The fourth flip-flop 14 may output the fourth input signal Q4 through a first output terminal Q, and a fourth inverted signal QB4 through a second output terminal QB, in response to the reference clock signal RCLK. The fourth inverted signal QB4 may have a level inverted from that of the fourth input signal Q4.

Accordingly, the fourth input signal Q4 may have the level information of the first frequency control signal SFC at a first cycle of the determination period 4T, the third input signal Q3 may have the level information of the first frequency control signal SFC at a second cycle of the determination period 4T, the second input signal Q2 may have the level information of the first frequency control signal SFC at a third cycle of the determination period 4T, and the first input signal Q1 may have the level information of the first frequency control signal SFC at a fourth cycle of the determination period 4T.

Referring to FIG. 4, the comparing unit 331B may receive the first to fourth input signals Q1 to Q4, and the first to fourth inverted signals QB1 to QB4 from the signal generating unit 331A. The comparing unit 331B may determine whether a level of the first frequency control signal SFC remains constant for the four cycles by comparing the first to fourth input signals Q1 to Q4 with each other, and comparing the first to fourth inverted signals QB1 to QB4 with each other.

More specifically, the comparing unit 331B according to an embodiment of the inventive concept may include a first NAND circuit 21, a second NAND circuit 22, and a latch unit 23 as illustrated in FIG. 5. The first NAND circuit 21 may be connected to the first output terminal Q of each of the first to fourth flip-flops 11, 12, 13, and 14 to receive the first to fourth input signals Q1 to Q4. The second NAND circuit 22 may be connected to the second output terminal QB of each of the first to fourth flip-flops 11, 12, 13, and 14 to receive the first to fourth inverted signals QB1 to QB4.

The first NAND circuit 21 may combine the first to fourth input signals Q1 to Q4 to output a first comparison signal CP-1. For example, when all of the first to fourth input signals Q1 to Q4 include first level information, the first NAND circuit 21 may output the first comparison signal CP-1 having second level information.

The second NAND circuit 22 may combine the first to fourth inverted signals QB1 to QB4 to output a second comparison signal CP-2. For example, when all of the first to fourth inverted signals QB1 to QB4 include the second level information, the second NAND circuit 22 may output the second comparison signal CP-2 having the first level information.

The latch unit 23 may be connected to each of an output terminal of the first NAND circuit 21 and an output terminal of the second NAND circuit 22, and may output a result signal RS having one of a first level and a second level on the basis of the first comparison signal CP-1 and the second comparison signal CP-2. As illustrated in FIG. 5, the latch unit 23 according to an embodiment of the inventive concept may include a third NAND circuit 23*a* and a fourth NAND circuit 23*b*.

More specifically, the third NAND circuit 23*a* may receive the first comparison signal CP-1 from the first NAND circuit 21 through a first input terminal, and receive an output signal of the fourth NAND circuit 23*b* through a second input terminal. The fourth NAND circuit 23*b* may receive the second comparison signal CP-2 from the second NAND circuit 22 through a first input terminal, and receive an output signal of the third NAND circuit 23*a* through a second input terminal. Additionally, the output signal of the third NAND circuit 23*a* may be supplied to the output unit 331C as the result signal RS.

As an example, when the first comparison signal CP-1 has the second level information, and the second comparison signal CP-2 has the first level information, the latch unit 23 may output a result signal RS having the first level.

Referring to FIG. 4, the output unit 331C may be connected to the comparing unit 331B to output the second frequency control signal SFC' having a level corresponding to the result signal RS. The output unit 331C according to an embodiment of the inventive concept may include a first inverter 31, a second inverter 32, and an output flip-flop 33 as illustrated in FIG. 5. The output flip-flop 33 included in the output unit 331C according to an embodiment of the inventive concept may be the D-flip-flop.

More specifically, the first inverter 31 may output an inverted result signal RS' having a level inverted from that of the result signal RS, and the second inverter 32 may be connected to an output terminal of the first inverter 31 to invert the inverted result signal RS' to the result signal again. The first inverter 31 and the second 32 may be configured to amplify the result signal. The first inverter 31 and the second 32 may be configured to delay the result signal so as to synchronize the result signal with the clock signal. The output flip-flop 33 may output the second frequency control signal SFC' such that the second frequency control signal SFC' has a level of the result signal RS from the next cycle of the preset determination period 4T.

As a more specific example, when the result signal RS has the first level, the first inverter 31 may output an inverted result signal RS' having the second level, and the second inverter 32 may output a result signal RS having the first level. The output flip-flop 33 may output the second frequency control signal SFC' having the first level at a fifth cycle in response to modified clock signal RCLK<5>.

As described above, by determining whether a level of the first frequency control signal SFC remains constant for the n cycles of the preset determination period, and then generating the second frequency control signal SFC', the filtering unit 331 may remove a glitch period included in the first frequency control signal SFC. To this end, by comparing the n input signals with each other, and comparing the n inverted signals having levels respectively inverted from those of the n input signals with each other, for the n cycles, the filtering unit 331 according to an embodiment of the inventive concept may effectively generate a glitch-free second frequency control signal SFC' from the first frequency control signal SFC.

Figure 6:
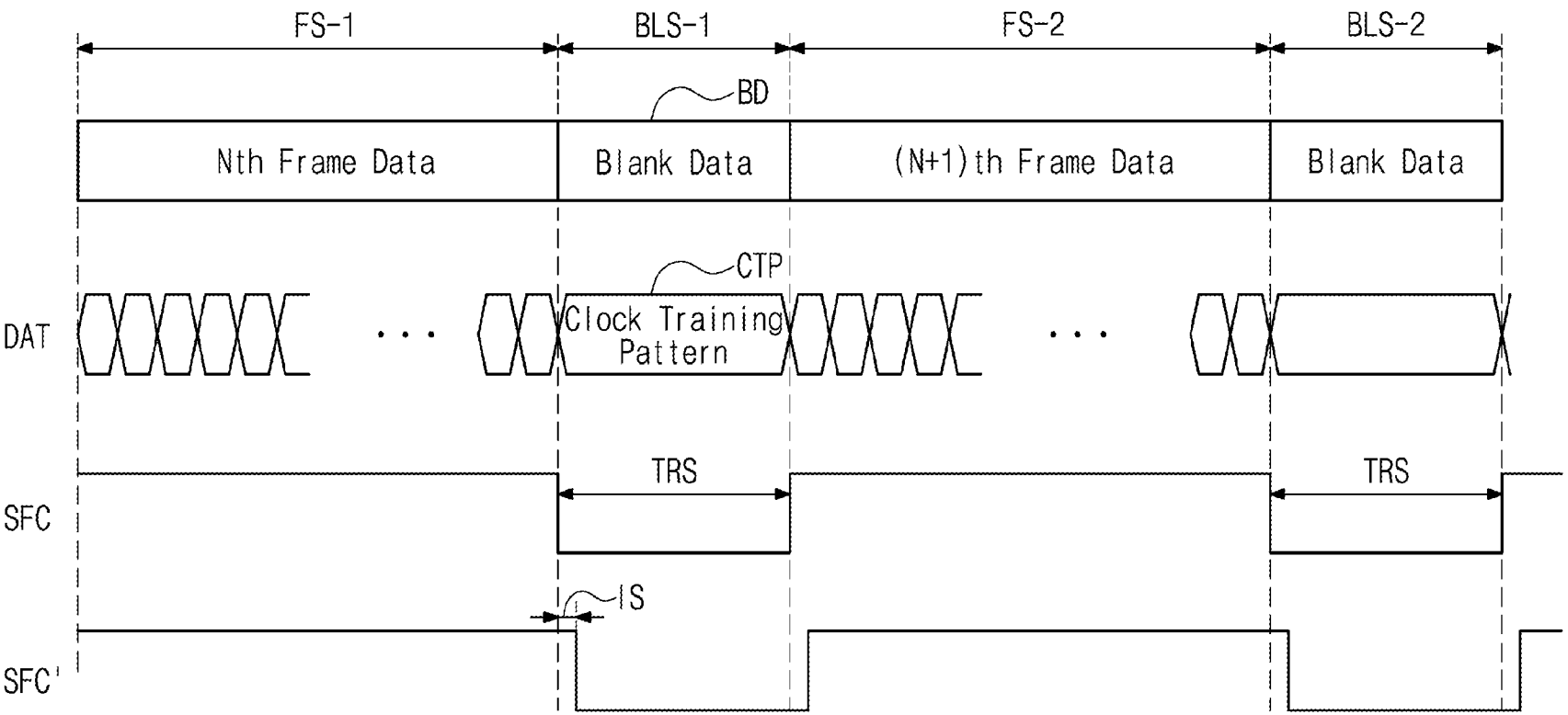
FIG. 6 is a conceptual diagram illustrating a plurality of image data and the first frequency control signal according to an embodiment of the inventive concept.

FIG. 6 is a conceptual diagram illustrating the plurality of image data DAT and the first frequency control signal SFC according to an embodiment of the inventive concept.

Referring to FIGS. 2 and 6, the signal control unit 100 according to an embodiment of the inventive concept may output the plurality of image data DAT corresponding to the plurality of frame images in a plurality of frame periods FS-1 and FS-2. The plurality of frame periods FS-1 and FS-2 may be alternately repeated with a plurality of blank periods BLS-1 and BLS-2 respectively. For example, as illustrated in FIG. 6, the first blank period BLS-1 may occur after the first frame period FS-1, the second frame period FS-2 may occur after the first blank period BLS-1, and the second blank period BLS-2 may occur after the second frame period FS-2.

Additionally, the signal control unit 100 according to an embodiment of the inventive concept may output a plurality of blank data BD in the plurality of blank periods BLS-1 and BLS-2. Each of the plurality of blank data BD may include pattern data CTP for clock training. Referring to FIGS. 2 and 6, the clock training unit 332 according to an embodiment of the inventive concept may perform clock training using the pattern data CTP.

As illustrated in FIG. 6, the first frequency control signal SFC may include transition periods TRS corresponding to the blank periods BLS-1 and BLS-2 so that the clock training is performed in the blank periods BLS-1 and BLS-2. For example, the first frequency control signal SFC may be a signal having falling edges at which the blank periods BLS-1 and BLS-2 start, and the first frequency control signal SFC is converted from the first level to the second level, and having rising edges at which the blank periods BLS-1 and BLS-2 end, and the first frequency control signal SFC is converted from the second level to the first level.

The second frequency control signal SFC' may be the first frequency control signal SFC from which the glitch phenomenon that has occurred thereto is removed. As an example, when the first frequency control signal SFC is a signal in which the glitch phenomenon has occurred at each of the falling edge and the rising edge as illustrated in FIG. 3, each of the falling edge and the rising edge of the second frequency control signal SFC' may be delayed by a preset time IS so as to remove noise caused by the glitch phenomenon. In other words, the second frequency control signal SFC' may be the first frequency control signal SFC the transition periods TRS of which are delayed by the preset time IS, as illustrated in FIG. 6.

According to an embodiment of the inventive concept, even when the transition sections TRS included in the first frequency control signal SFC are delayed by the preset time IS, there may be no significant influence on an operation of the next frame.

Figure 7:
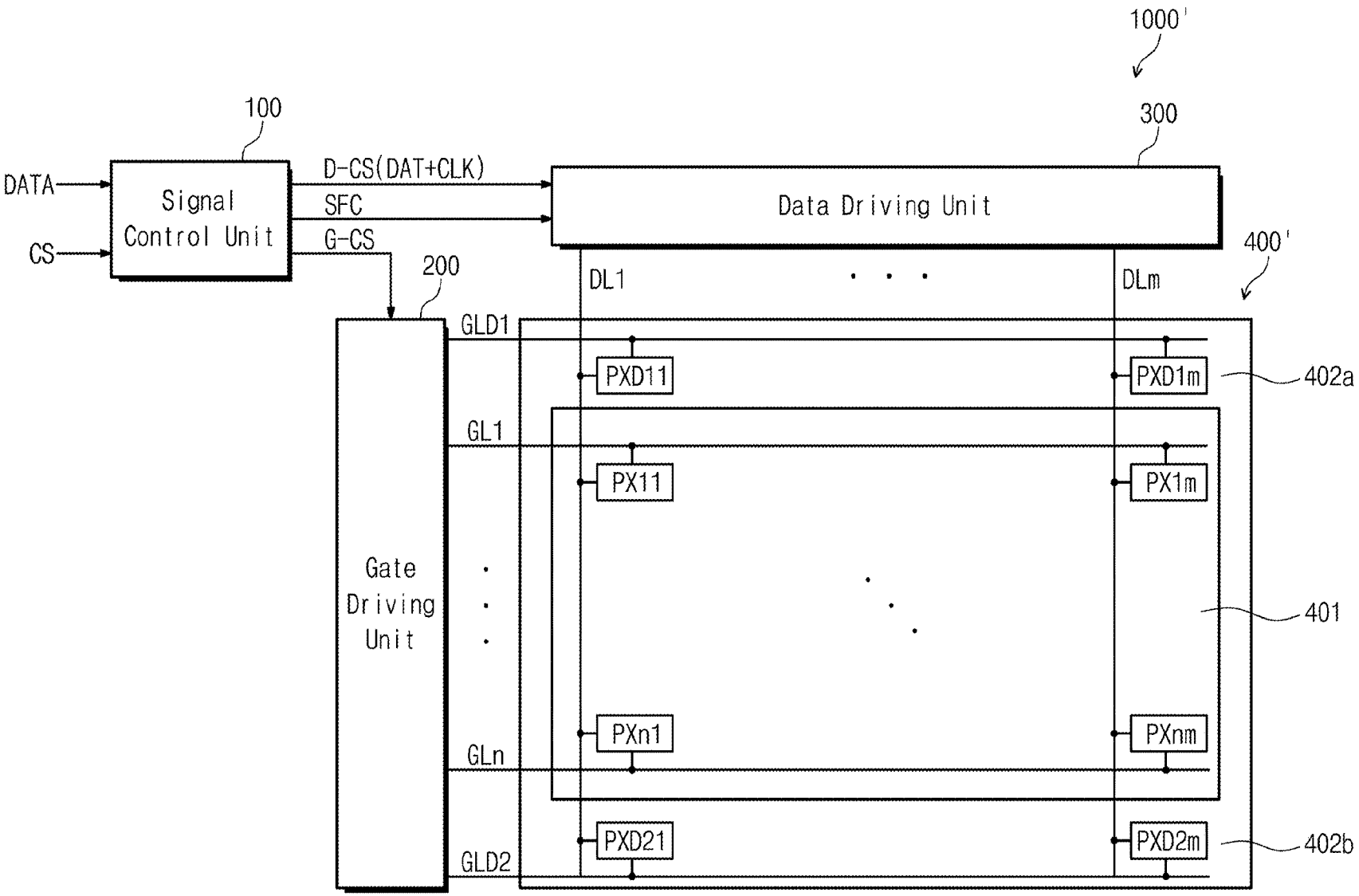
FIG. 7 is a block diagram illustrating a display device according to another embodiment of the inventive concept.
Figure 8:
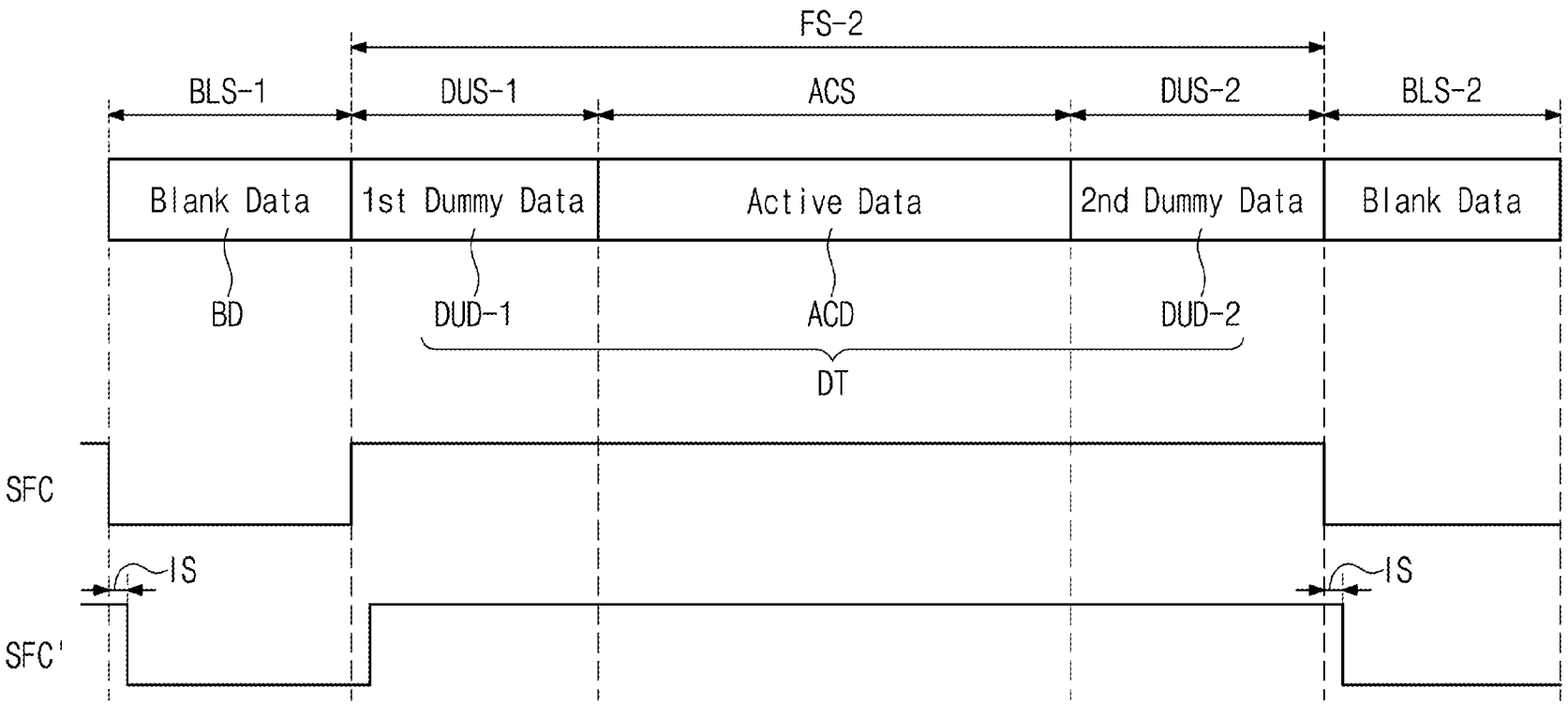
FIG. 8 illustrates image data outputted from a signal control unit of the display device illustrated in FIG. 7.

FIG. 7 is a block diagram illustrating a display device 1000' according to another embodiment of the inventive concept, and FIG. 8 illustrates image data outputted from the signal control unit 100 of the display device 1000' illustrated in FIG. 7. Description will not be given of components previously described in detail in FIG. 1.

Referring to FIG. 7, a display panel 400' may include an active area 401, and first and second dummy areas 402*a* and 402*b*. The first and second dummy areas 402*a* and 402*b* may be disposed respectively adjacent to an upper portion of the active area 401, in which a first gate line GL1 is disposed, and a lower portion of the active area 401, in which an n-th gate line GLn is disposed. In FIG. 7, a case is illustrated that the display panel 400' includes the first and second dummy areas 402*a* and 402*b*, but a dummy area may be disposed in only one of upper and lower portions of a display panel.

The active area 401 may include a plurality of pixels PX11 to PXnm defined by a plurality of gate lines GL1 to GLn, and a plurality of data lines DL1 to DLm.

The first dummy area 402*a* may include a plurality of dummy pixels PXD11 to PXD1*m* defined by a first dummy gate line GLD1, and the plurality of data lines DL1 to DLm, and the second dummy area 402*b* may include a plurality of dummy pixels PXD21 to PXD2*m* defined by a second dummy gate line GLD2, and the plurality of data lines DL1 to DLm.

The signal control unit 100 according to an embodiment of the inventive concept may include, in the plurality of image data DAT, dummy data to be respectively outputted to the first dummy area 402*a* and the second dummy area 402*b*, and output the plurality of image data DAT. For example, the signal control unit 100 may output the plurality of image data DAT including a plurality of active data to be respectively outputted to the plurality of pixels PX11 to PXnm, and the plurality of dummy data to be respectively outputted to the plurality of dummy pixels PXD11 to PXD1*m*, and PXD21 to PXD2*m*.

As a more specific example, the plurality of image data DAT according to an embodiment of the inventive concept may respectively include the at least one of dummy data or the active data. Referring to FIG. 8, active data ACD, and first and second dummy data DUD-1 and DUD-2 corresponding to one frame may define one frame image data DT. That is, one frame period FS-2 may be composed of a first dummy data period DUS-1, an active data period ACS, and a second dummy data period DUS-2.

The first and second blank periods BLS-1 and BLS-2 may be positioned respectively before and after the frame period FS-2. As a more specific example, the first dummy data period DUS-1 may be positioned between the first blank period BLS-1 and the active data period ACS, and the second dummy data period DUS-2 may be positioned between the active data period ACS and the second blank period BLS-2.

Even when the first frequency control signal SFC having the transition period TRS corresponding to the first blank period BLS-1 is delayed by the preset time IS, a delayed time period corresponding to the preset time IS may be positioned in the first dummy data period DUS-1. Accordingly, there may be no influence on an operation of the data driving unit 300 in the active period ACS.

In the description above, an embodiment is described of the second frequency control signal SFC' which is the first frequency control signal SFC of which each of the falling and rising edges is delayed by the preset time IS. According to another embodiment of the inventive concept, however, the second frequency control signal SFC' may be the first frequency control signal SFC of which only one of the falling and rising edges is delayed by the preset time IS.

Figure 9:
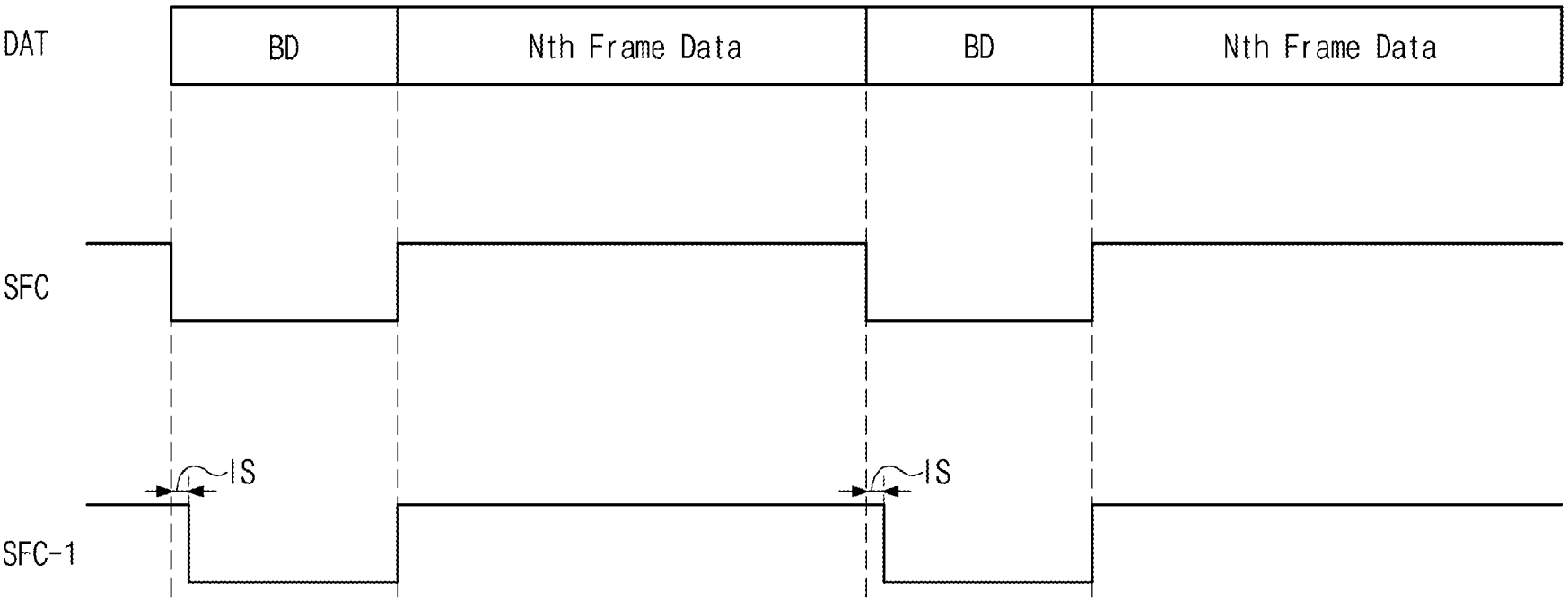
FIG. 9 is a waveform diagram illustrating a first frequency control signal and a second frequency control signal according to another embodiment of the inventive concept.

FIG. 9 is a waveform diagram illustrating the first frequency control signal SFC and a second frequency control signal SFC-1 according to another embodiment of the inventive concept.

A filtering unit according to another embodiment of the inventive concept may determine a level of the first frequency control signal SFC for a preset period of time, and then generate the second frequency control signal SFC-1 which is the first frequency control signal SFC the falling edge of which is delayed by the preset time IS. The rising edge of the second frequency control signal SFC-1 may be synchronized with the rising edge of the first frequency control signal SFC. In this case, a transition period TRS-1 of the second frequency control signal SFC-1 may be shorter than the transition period TRS of the first frequency control signal SFC.

A clock training unit may perform clock training for the transition period TRS-1 of the second frequency control signal SFC-1.

According to an embodiment of the inventive concept, even when a glitch occurs in a control signal due to noise or the like in the process of transmission from a signal control unit to a data driving unit, the data driving unit may remove the glitch included in the control signal, thereby improving driving reliability of a display device.

Although the exemplary embodiments of the inventive concept have been described herein, it is understood that various changes and modifications can be made by those skilled in the art within the spirit and scope of the inventive concept defined by the following claims or the equivalents.

Therefore, the scope of the inventive concept is defined by the following claims or the equivalents other than the foregoing detailed description.

What is claimed is:

1. A display device comprising:

a signal control unit configured to output a gate driving signal, a clock signal including frequency information, a plurality of image data corresponding to a plurality of frame images, and a first frequency control signal for defining a plurality of frame periods in which the plurality of frame images are respectively displayed;

a data driving unit including:

a signal processing unit configured to train the clock signal received from the signal control unit to generate an internal clock signal, and a data converting unit configured to convert the plurality of image data to a plurality of data voltages in response to the internal clock signal, and to output the data voltages;

a gate driving unit configured to output a gate signal in response to the gate driving signal received from the signal control unit; and a display panel configured to display the plurality of frame images corresponding respectively to the plurality of data voltages in response to the gate signal, wherein the signal processing unit includes:

a filtering unit configured to receive the first frequency control signal, and generate a second frequency control signal; and a clock training unit configured to perform clock training for generating the internal clock signal in response to the second frequency control signal, wherein a level of the first frequency control signal and a level of the second frequency control signal are different for a preset time after a falling point at which the first frequency control signal is converted from a first level to a second level.

2. The display device of claim 1, wherein the second frequency control signal having the first level when a level of the first frequency control signal is maintained at the first level for a preset determination period, and having the second level when a level of the first frequency control signal is maintained at the second level for the determination period, the data driving unit further comprises a reference clock signal generating unit configured to generate a reference clock signal for determining the determination period, and the filtering unit compares a level of the first frequency control signal for each cycle of the reference clock signal, and, when the first frequency control signal has been maintained at one level of the first and second levels for at least n cycles of the reference clock signal, where n is a natural number greater than or equal to two, the filtering unit converts a level of the second frequency control signal to the one level of the first frequency control signal from an (n+1)-th cycle of the reference clock signal.

3. The display device of claim 2, wherein, when a level of the first frequency control signal is not maintained to be constant at one level of the first and second levels for the n cycles, the filtering unit maintains a level of the second frequency control signal to be unconverted in the (n+1)-th cycle.

4. The display device of claim 2, wherein the filtering unit comprises:

a signal generating unit configured to output n input signals respectively including level information of the first frequency control signal in the n cycles;

a comparing unit configured to compare the n input signals to determine whether a level of the first frequency control signal remains constant for the n cycles; and an output unit configured to output, when the comparing unit determines that the level of the first frequency control signal has remained constant for the n cycles, the second frequency control signal having, in the (n+1)-th cycle, the same level as the level of the first frequency control signal.

5. The display device of claim 4, wherein the signal generating unit comprises n flip-flops configured to generate the n input signals, and n inverted signals respectively having level values inverted from level values of the n input signals.

6. The display device of claim 5, wherein the comparing unit comprises:

a first NAND circuit configured to combine the n input signals to output a first comparison signal;

a second NAND circuit configured to combine the n inverted signals to output a second comparison signal; and a latch unit connected to each of the first NAND circuit and the second NAND circuit, and configured to output a result signal having one of the first level and the second level on the basis of the first comparison signal and the second comparison signal.

7. The display device of claim 6, wherein the output unit comprises:

a first inverter configured to output an inverted result signal having a level inverted from a level of the result signal;

a second inverter configured to invert the inverted result signal to the result signal again; and an output flip-flop configured to convert, in the (n+1)-th cycle, a level of the second frequency control signal to the level of the result signal.

8. The display device of claim 1, wherein the signal control unit further outputs a plurality of blank data, the plurality of image data are outputted in the plurality of frame periods, and the plurality of blank data are outputted in a plurality of blank periods alternately repeated with the plurality of frame periods respectively.

9. The display device of claim 8, wherein each of the plurality of blank data comprises pattern data for the clock training, and the clock training unit performs the clock training using the pattern data.

10. The display device of claim 8, wherein each of the plurality of image data comprises dummy data and active data, one frame period of the plurality of frame periods is disposed between a first blank period and a second blank period, and a dummy data period included in the one frame period is disposed to be adjacent to at least one of the first blank period or the second blank period.

11. A data driving unit comprising:

a filtering unit configured to receive a first frequency control signal from a signal control unit, and to generate a second frequency control signal;

a clock training unit configured to receive a clock signal including frequency information from the signal control unit, and to generate an internal clock signal corresponding to the clock signal while performing training of the clock signal in response to the second frequency control signal; and a data converting unit configured to convert a plurality of image data corresponding to a plurality of frame images to a plurality of data voltages in response to the internal clock signal, and to output the data voltages, wherein a level of the first frequency control signal and a level of the second frequency control signal are different for a preset time after a falling point at which the first frequency control signal is converted from a first level to a second level.

12. The data driving unit of claim 11, further comprising a reference clock signal generating unit configured to generate a reference clock signal for determining the determination period, wherein the second frequency control signal converted to have the same level as one level on the basis that a level of the first frequency control signal is maintained to be constant at the one level of the first level and the second level for a preset determination period, the filtering unit compares a level of the first frequency control signal for each cycle of the reference clock signal, and, when the first frequency control signal has been maintained at one level of the first and second levels for at least n cycles of the reference clock signal, where n is a natural number greater than or equal to two, the filtering unit converts a level of the second frequency control signal to the one level of the first frequency control signal from an (n+1)-th cycle of the reference clock signal.

13. The data driving unit of claim 12, wherein, when a level of the first frequency control signal is not maintained to be constant at one level of the first and second levels for the n cycles, the filtering unit maintains a level of the second frequency control signal to be unconverted in the (n+1)-th cycle.

14. The data driving unit of claim 12, wherein the filtering unit comprises:

a signal generating unit configured to output n input signals respectively including level information of the first frequency control signal in the n cycles;

a comparing unit configured to compare the n input signals to determine whether a level of the first frequency control signal remains constant for the n cycles; and an output unit configured to output, when the comparing unit determines that the level of the first frequency control signal has remained constant for the n cycles, the second frequency control signal having, in the (n+1)-th cycle, the same level as the level of the first frequency control signal.

15. The data driving unit of claim 14, wherein the signal generating unit comprises n flip-flops configured to generate the n input signals, and n inverted signals respectively having level values inverted from level values of the n input signals.

16. The data driving unit of claim 15, wherein the comparing unit comprises:

a first NAND circuit configured to combine the n input signals to output a first comparison signal;

a second NAND circuit configured to combine the n inverted signals to output a second comparison signal; and a latch unit connected to each of the first NAND circuit and the second NAND circuit, and configured to output a result signal having one of the first level and the second level on the basis of the first comparison signal and the second comparison signal.

17. The data driving unit of claim 14, wherein the output unit comprises:

a first inverter configured to output an inverted result signal having a level inverted from a level of the result signal;

a second inverter configured to invert the inverted result signal to the result signal again; and an output flip-flop configured to convert, in the (n+1)-th cycle, a level of the second frequency control signal to the level of the result signal.

18. A display device comprising:

a signal control unit configured to output a gate driving signal, a clock signal including frequency information, a plurality of image data corresponding to a plurality of frame images, and a first frequency control signal for defining a plurality of frame periods in which the plurality of frame images are respectively displayed;

a data driving unit including:

a signal processing unit configured to train the clock signal received from the signal control unit to generate an internal clock signal, and a data converting unit configured to convert the plurality of image data to a plurality of data voltages in response to the internal clock signal, and to output the data voltages;

a gate driving unit configured to output a gate signal in response to the gate driving signal received from the signal control unit; and a display panel configured to display the plurality of frame images corresponding respectively to the plurality of data voltages in response to the gate signal, wherein the signal processing unit includes:

a filtering unit configured to receive the first frequency control signal, and generate a second frequency control signal; and a clock training unit configured to perform clock training for generating the internal clock signal in response to the second frequency control signal, wherein the second frequency control signal is a signal in which a transition period in which the first frequency control signal is converted from a first level to a second level is delayed for a preset time.

* * * * *